US007134478B2

(12) United States Patent
Ohtake et al.

(10) Patent No.: US 7,134,478 B2
(45) Date of Patent: Nov. 14, 2006

(54) METHOD OF DIE CASTING SPHEROIDAL GRAPHITE CAST IRON

(75) Inventors: Kazumi Ohtake, Toyota (JP); Akira Manabe, Aichi-ken (JP); Yoshihiro Hibino, Aichi-ken (JP); Takahiro Sato, Chiryu (JP); Kazufumi Niwa, Kariya (JP)

(73) Assignees: Toyota Jidosha Kabushiki Kaisha, Toyota (JP); Aisin Takaoka Co., Ltd., Toyota (JP)

( * ) Notice: Subject to any disclaimer, the term of this patent is extended or adjusted under 35 U.S.C. 154(b) by 251 days.

(21) Appl. No.: 10/761,226

(22) Filed: Jan. 22, 2004

(65) Prior Publication Data

US 2004/0250927 A1 Dec. 16, 2004

(30) Foreign Application Priority Data

Jan. 27, 2003 (JP) ..... 2003-017834

(51) Int. Cl.
*B22D 17/08* (2006.01)

(52) U.S. Cl. ..... 164/120; 164/113

(58) Field of Classification Search ..... 164/113, 164/120

See application file for complete search history.

(56) References Cited

FOREIGN PATENT DOCUMENTS

| | | | |
|---|---|---|---|
| JP | A 56-086645 | | 7/1981 |
| JP | 59-110455 | * | 6/1984 |
| JP | A 02-165859 | | 6/1990 |
| JP | A 09-239513 | | 9/1997 |
| JP | A 09-239514 | | 9/1997 |
| JP | A 2000-45011 | | 2/2000 |
| JP | A 2000-288716 | | 10/2000 |

* cited by examiner

*Primary Examiner*—Kuang Y. Lin
(74) *Attorney, Agent, or Firm*—Oliff & Berridge, PLC

(57) ABSTRACT

A method of die casting spheroidal graphite cast iron able to prevent formation of chill crystals to allow the crystallization of fine spheroidal graphite and simultaneously prevent the formation of internal defects, including the steps of preparing a die formed with a heat insulation layer at inside walls of a cavity, filling molten metal having a composition of the spheroidal graphite cast iron through a runner into the cavity, closing the runner so as to seal the cavity right before the molten metal in the cavity starts to solidify, and allowing the molten metal to solidify by the action of the inside pressure caused by crystallization of the spheroidal graphite in the sealed cavity.

2 Claims, 11 Drawing Sheets

METHOD OF DIE CASTING SPHEROIDAL GRAPHITE CAST IRON

BACKGROUND OF THE INVENTION

1. Field of the Invention

The present invention relates to a method of die casting spheroidal graphite cast iron.

2. Description of the Related Art

Spheroidal graphite cast iron is also called "ductile cast iron" and "nodular cast iron" and contains graphite in a spheroidal form, so is remarkably higher in strength and ductility compared with another cast iron with no spheroidal graphite and features a higher strength and toughness comparable with cast steel.

In the past, spheroidal graphite cast iron had been cast by sand molds, but due to the gradual cooling of the molten metal, the crystallized spheroidal graphite became coarse and there were limits to improvement of the mechanical properties. Further, castings made by sand molds are limited in the accuracy of their shape and dimensions.

It has therefore been demanded to obtain spheroidal graphite cast iron products improved in mechanical properties or accuracy of shape and dimensions exceeding the limits due to such sand mold casting. To meet with this demand, experiments have been conducted on die casting spheroidal graphite cast iron. If using die casting, a far faster cooling rate can be obtained compared with sand mold casting, so the spheroidal graphite finely crystallizes and the cast structure as a whole also becomes finer, so it is possible to improve the strength and ductility and also improve the accuracy of shape and dimensions.

With die casting, however, formation of chill crystals (rapidly cooled structure made of cementite) was unavoidable due to the fast cooling rate. If chill crystals are formed, the hardness of the casting becomes higher, but the toughness ends up being deteriorated and in the final analysis excellent mechanical properties cannot be obtained by die casting. Therefore, for example, as shown by the method disclosed in Japanese Unexamined Patent Publication (Kokai) No. 2000-288716, post-treatment such as heat treating the casting to break down the cementite forming the chill crystals into ferrite and carbon etc. has been necessary.

Another important point has been that in the conventional method, there has been the major problem that formation of internal defects such as shrinkage cavities was unavoidable both when using sand molds or dies and therefore the fatigue strength declined. In general, castings are prevented from the formation of shrinkage cavities by more slowly solidifying the feeder than the product section and supplementing molten metal from the feeder to the product section.

Here, since cast iron expands in volume due to graphite crystallization at the time of solidification, the method has been proposed of constraining this expansion of volume to cause the generation of internal pressure in the cavity and using this internal pressure to prevent the formation of shrinkage cavities. Specifically, the strength of the sand mold has been increased or the sand mold backed up by a die (back metal shell) to constrain expansion of volume.

However, in these methods, since a feeder is used, the expansion of volume by the crystallization of graphite ends up being eased by the flow of molten metal to the not yet solidified feeder, so in fact not that much of an effect of generation of internal pressure due to the constraint of expansion is obtained. Further, with the back metal shell method, formation of the sand mold is difficult and the sand mold layer has to be made thicker, so cannot be effectively backed up by a die. The sand mold part ends up moving so again a sufficient effect of generation of internal pressure due to the constraint of expansion cannot be obtained.

On the other hand, as a non-feeder design, the product section and gate have been optimized in shape, but no measure has been taken to prevent the formation of casting defects by constraining the expansion of volume.

SUMMARY OF THE INVENTION

An object of the present invention is to provide a method of die casting of spheroidal graphite cast iron able to prevent formation of chill crystals (cementite) and thereby allow crystallization of fine spheroidal graphite and simultaneously to prevent the formation of internal defects.

To attain the above object, there is provided a method of die-casting spheroidal graphite cast iron, comprised of the steps of preparing a die formed with a heat insulation layer at inside walls of a cavity, filling molten metal having a composition of the spheroidal graphite cast iron through a runner into the cavity, closing the runner so as to seal the cavity right before the molten metal in the cavity starts to solidify, and allowing the molten metal to solidify by the action of the inside pressure caused by crystallization of the spheroidal graphite in the sealed cavity.

In the method of the present invention, a heat insulation layer provided at the inside walls of the die cavity prevents excess rapid cooling to prevent formation of chill crystals while allowing the crystallization of spheroidal graphite. Further, the runner is closed right before the molten metal in the cavity starts to solidify to seal the cavity and thereby constrain the expansion of volume due to the crystallization of the spheroidal graphite, thereby causing the generation of internal pressure in the cavity so that the solidification of the molten metal in the cavity proceeds under the action of this internal pressure to prevent the formation of casting defects. Due to this, it is possible to cast spheroidal graphite cast iron having an excellent spheroidal structure (preferably a spheroidal graphite rate of at least 85%).

The heat insulation layer preferably has a heat conductivity of not more than 0.25 W/mK and a thickness of not more than 600 μm. Further, the heat insulation layer preferably is substantially comprised of hollow ceramic particles, solid ceramic particles, and a binder.

BRIEF DESCRIPTION OF THE DRAWINGS

These and other objects and features of the present invention will become clearer from the following description of the preferred embodiments given with reference to the attached drawings, wherein:

FIG. 6A is macrosketch of a horizontal cross-section of a cylindrical sample obtained by die/constraint casting according to the present invention, while

FIGS. 9A and 9B are scanning electron micrographs of the microstructure of fracture origins in a sample fracture surface after a fatigue test, wherein FIG. 9A shows die/constraint casting and FIG. 9B shows open casting by a sand mold or die;

DESCRIPTION OF THE PREFERRED EMBODIMENTS

Preferred embodiments of the present invention will be described in detail below while referring to the attached figures.

Figure 1:
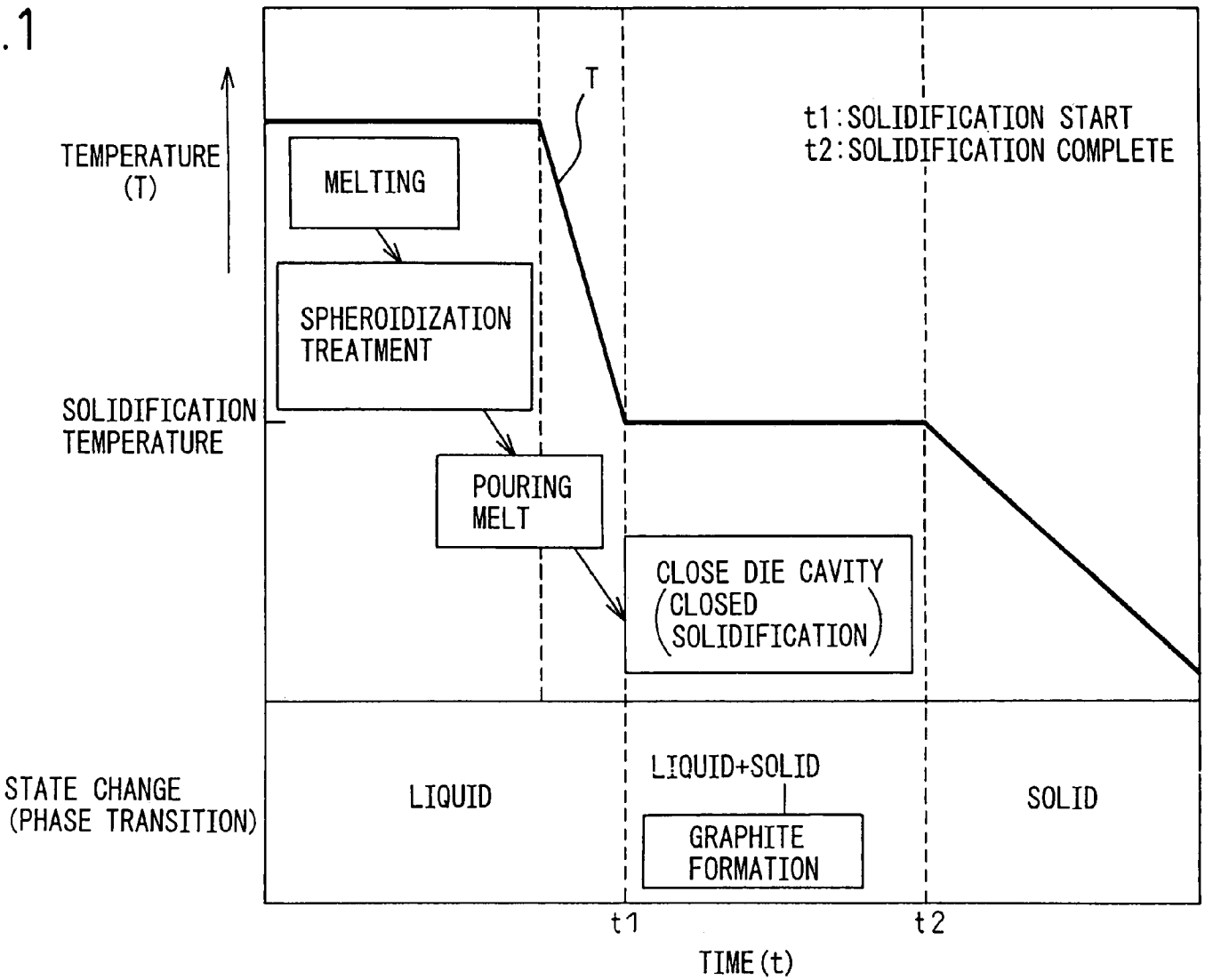
FIG. 1 is a graph of the casting process according to the method of the present invention.

Referring to FIG. 1, the casting process according to the method of the present invention will be explained. FIG. 1 shows the temperature T and state change of the molten metal in the cavity on its ordinate with respect to trends in the elapsed time t shown on the abscissa. As shown at the top left in the figure, materials blended to give a predetermined composition of spheroidal graphite cast iron are melted to prepare molten metal. This is subjected to the usual spheroidization treatment, then poured into a die provided in advance with a heat insulation layer on the walls of its cavity. The temperature of the molten metal in the die cavity is constantly monitored by a suitable temperature measuring apparatus (not shown). At the time t1 when the molten metal temperature reaches the known solidification start temperature, the runner of the die is closed to air-tightly seal the inside of the cavity.

Figure 2:
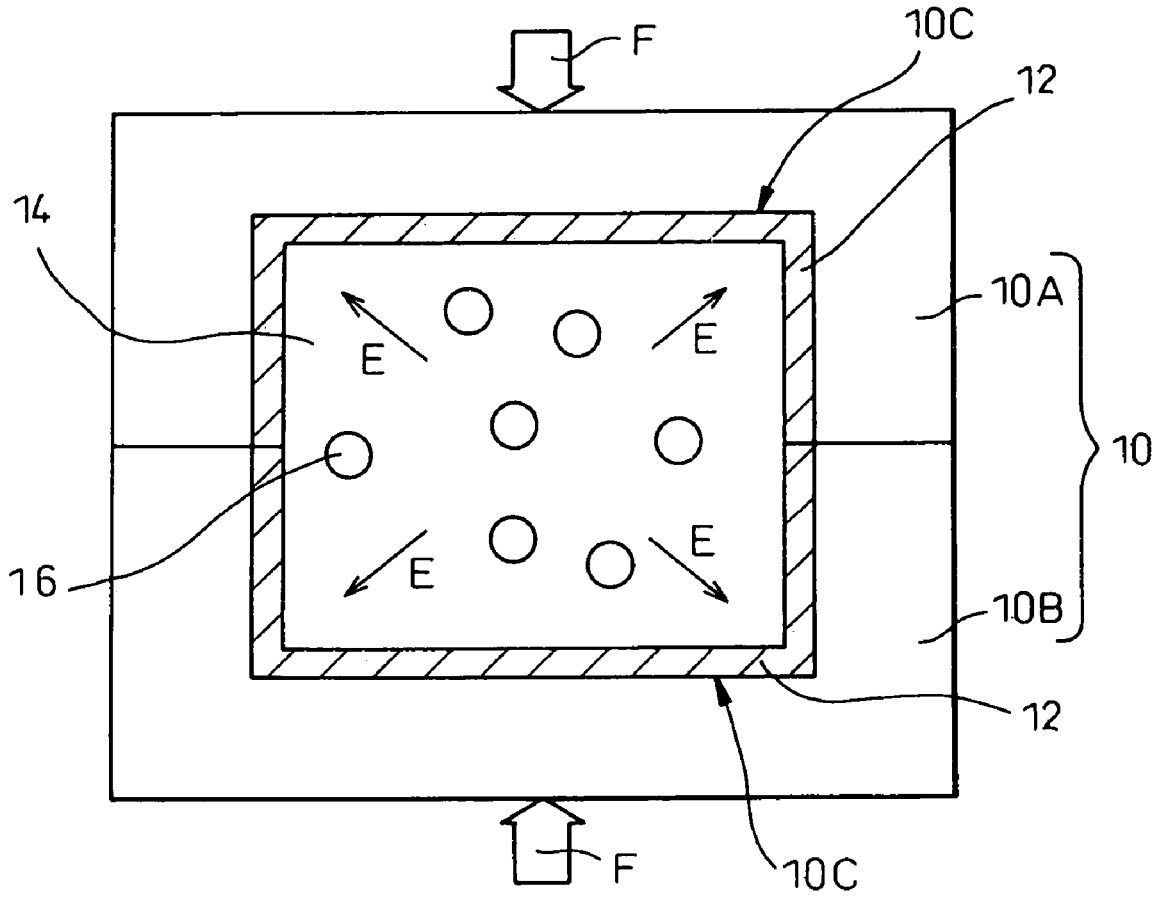
FIG. 2 is a sectional view showing a die after closing of the runner and the molten metal in the die cavity.

FIG. 2 schematically shows the die after runner closure and the molten metal in the die cavity. The die 10 consists of an upper die half 10A and a lower die half 10B clamped together. The clamping force F is shown by the upper and lower white arrows. The upper die half 10A and lower die half 10B are formed in advance with the heat insulation layer 12 at the inside walls of the cavity 10C.

The cast iron molten metal 14 in the cavity crystallizes in solid phase along with the elapse of time from the solidification start time t1. In the process, spheroidal graphite 16 of a lower density than the metal phase is crystallized, whereby the metal tries to expand in volume as shown by the four solid arrows E, but since the cavity 10C is sealed, the expansion of volume is constrained and internal pressure is generated in the molten metal 14. The die 10 is provided with enough rigidity to sufficiently hold this internal pressure. The clamping force is also far greater than the internal pressure. Therefore, the internal pressure does not cause die movement, and the metal solidifies in the state with the internal pressure held. At the time t2, the entire molten metal in the cavity 10C finishes solidifying. Note that during the period from the solidification start t1 to the solidification end t2, the temperature of the molten metal in the cavity remains substantially constant as illustrated in FIG. 1 due to the solidification latent heat.

In this way, in the present invention, (1) a heat insulation layer is provided at the inner walls of the die cavity to control the cooling rate and stably ensure the crystallization of spheroidal graphite and (2) the internal pressure caused by constraining the expansion of volume due to the crystallization of the spheroidal graphite by sealing the die cavity is made to continually act on the molten metal until the solidification finishes.

Due to this, spheroidal graphite finer than with sand mold casting is allowed to crystallize and, simultaneously, the formation of casting defects is effectively suppressed due to the solidification under the action of the internal pressure so as to enable the production of spheroidal graphite cast iron superior in strength and toughness.

EXAMPLES

Spheroidal graphite cast iron was cast by the die/constraint casting of the present invention. Further, for comparison, castings made by sand mold casting and non-constraint die casting and HIP castings made from these under pressure were prepared. The composition of the castings was Fe-3.6C-3.0Si-0.25Mn-xMg (wt %). Here, the amount "x" of addition of the spheroidization agent Mg was made the amount most promoting spheroidization, that is, 0.025 wt % in the case of die casting and 0.04 wt % in the case of sand mold casting. The impurities were made less than 0.03 wt % of phosphorus and less than 0.01 wt % of sulfur. The pouring temperature into the casting mold was made 1400° C. The casting conditions of the example of the present invention and comparative examples are shown together in Table 1.

TABLE 1

| | Casting Method | | |
|---|---|---|---|
| No. | T/P | Casting design | Shape |
| 1 | Die/constraint-present invention | Die + heat insulation coating, clamping force 10 ton | ϕ30 × 200 |
| 2 | Sand mold/Y-block/open-comparative | $CO_2$ sand mold | JIS-B |
| 3 | Die (open)-comparative | Die + heat insulation coating | ϕ30 × 180 |
| 4 | Sand mold/Y-block/HIP-comparative | $CO_2$ sand mold | JIS-B |
| 5 | Die/HIP-comparative | Die + heat insulation coating | ϕ30 × 180 |

Figure 3A:
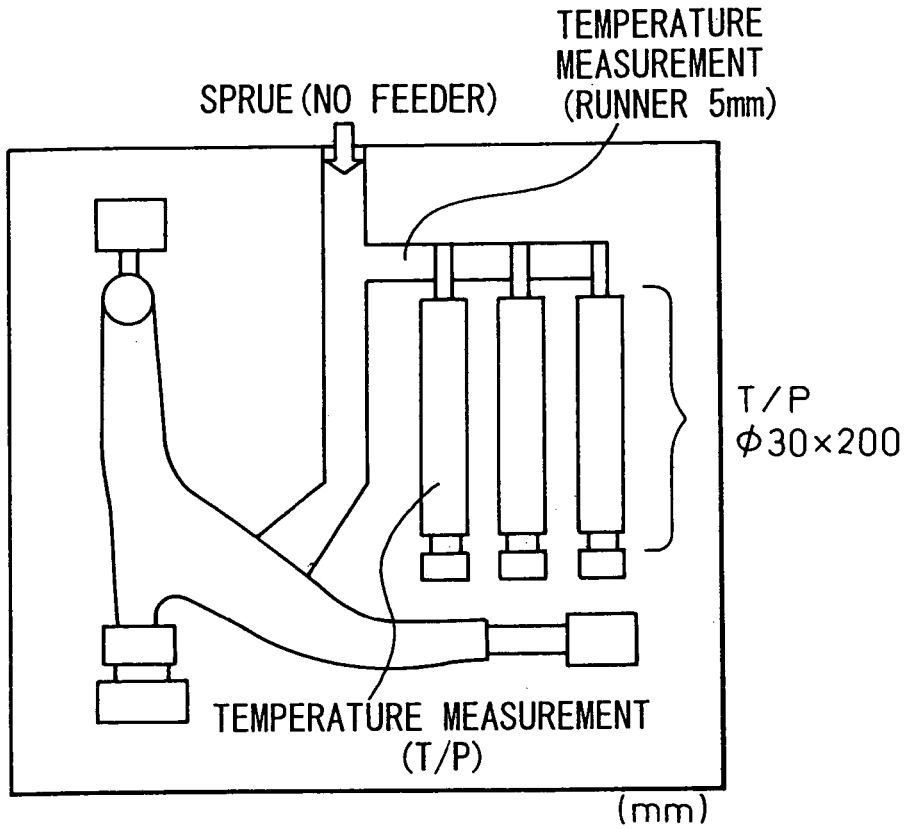
FIG. 3A is a die structure used for die/constraint casting of an example of the present invention.

In Table 1, Sample (T/P) No. 1 is an example of the present invention and shows the die structure used in FIG. 3A. No feeder is used. The molten metal poured from the sprue is injected through the runner into the die cavity (in the figure, the die location indicated by "T/P").

Figure 3B:
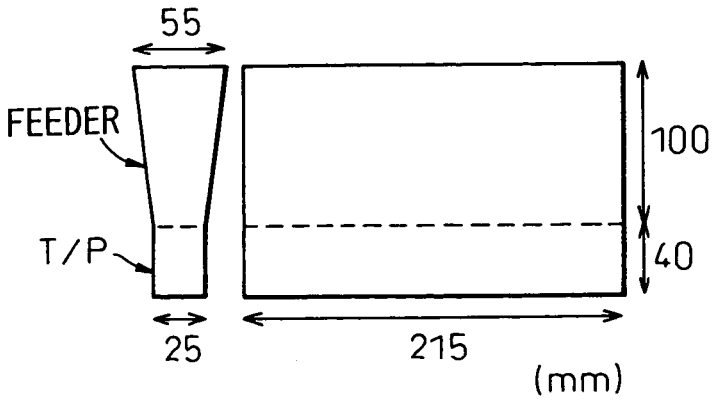
FIG. 3B is a sand mold used for a comparative example.
Figure 3C:
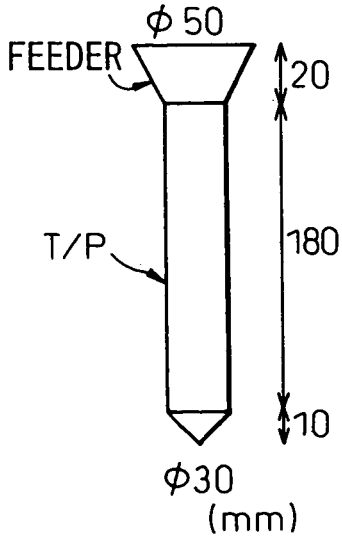
FIG. 3C is a side view of a die used for a comparative example.

Sample Nos. 2 to 5 are comparative examples. Each uses a casting design using a feeder. Sample No. 2 and Sample No. 4 are cast by open systems by a sand mold Y-block shown in FIG. 3B, while Sample No. 3 and Sample No. 5 are cast by open systems by die rods shown in FIG. 3C. Among these, Sample No. 4 and Sample No. 5 are castings with HIP treatment (hot isostatic pressing).

Here, in the die structure of the example of the present invention (FIG. 3A), the inside walls of the die cavity (T/P parts) were given the following heat insulation coating in advance. The runner was left with no heat insulation coating.

Heat Insulation Coating

Composition: Hollow mullite powder (particle size 50 μm)+silica powder (solid, particle size of not more than 10 μm)

Ratio (by weight): Mullite:silica=30:70

Binder: 5 wt % bentonite and 10 wt % water glass on the basis of 100 wt % gross

Coated thickness: 600 μm

Figure 4:
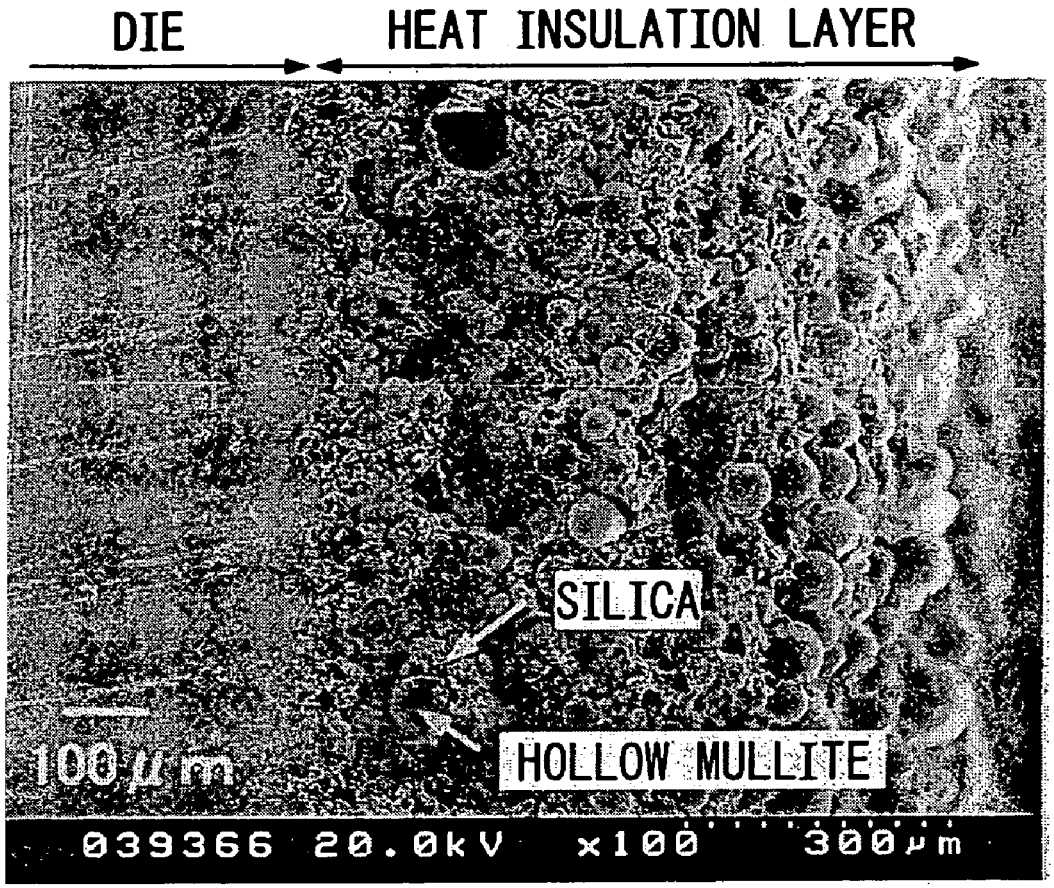
FIG. 4 is a scanning electron micrograph of the microstructure of a heat insulation coating comprised of powder particles applied to the inside walls of a die cavity according to the present invention.

FIG. 4 is a scanning electron micrograph of the inside wall of die cavity provided with the above-mentioned heat insulation coating. It can be seen that the inside wall of die cavity has a porous heat insulation coating formed thereon with a uniform mixture of hollow mullite particles and solid silica particles.

During the casting according to the present invention, as shown in FIG. 3A, temperature was constantly monitored by temperature sensors provided at the runner and the die cavity (T/P parts). The measured results are shown in FIG. 5.

Figure 5:
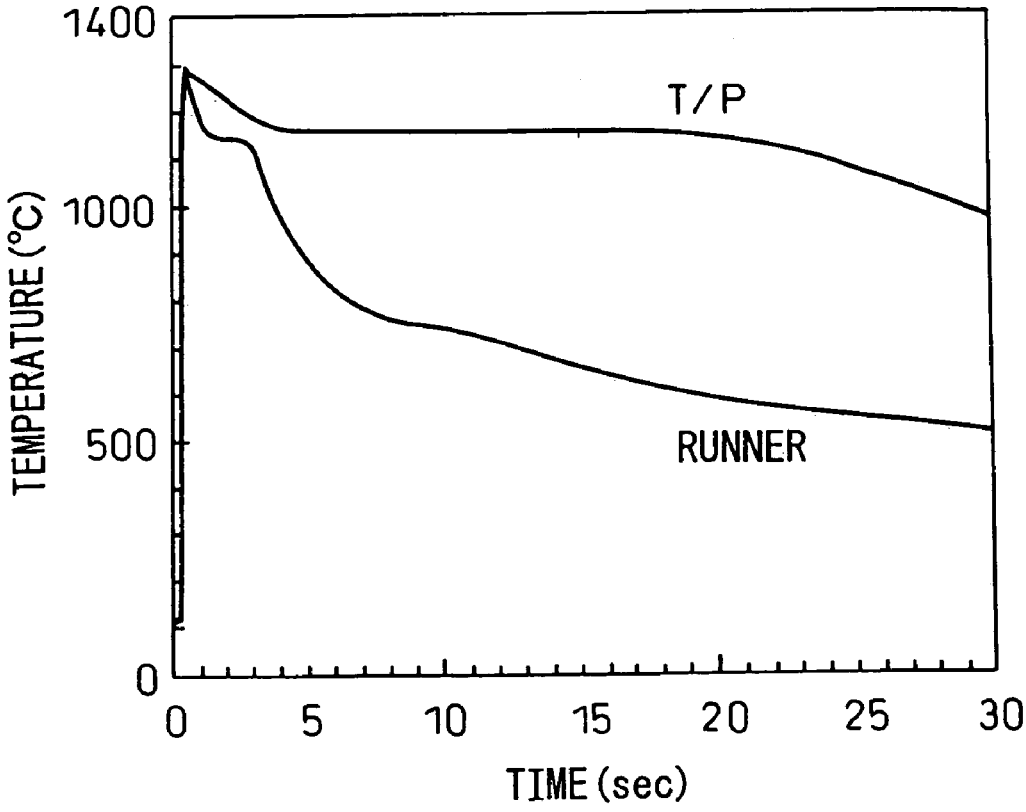
FIG. 5 is a graph of a temperature change curve measured for a runner and die cavity in die/constraint casting according to the present invention.

As shown in FIG. 5, the runner with no heat insulation coating rapidly dropped in temperature and reached the solidification temperature of the tested cast iron (about 1150° C.) early, so the molten metal in the runner finished solidifying a few seconds after the start of casting. That is, it started solidifying at the left end of the zone in which the temperature curve of the runner in the figure is horizontal and finished solidifying at the right end of the zone.

As opposed to this, the inside of the cavity given the heat insulation coating (in the figure, "T/P") is held at a higher temperature than the solidification temperature (about 1150° C.) even after the runner finishes solidifying and is maintained in a molten state. That is, right after the runner finishes solidifying, the solidification starts in the cavity (left end in horizontal zone of T/P temperature curve in figure). Due to this, in the cavity, the entire process of solidification proceeds in the sealed state with the runner closed.

Figure 6A:
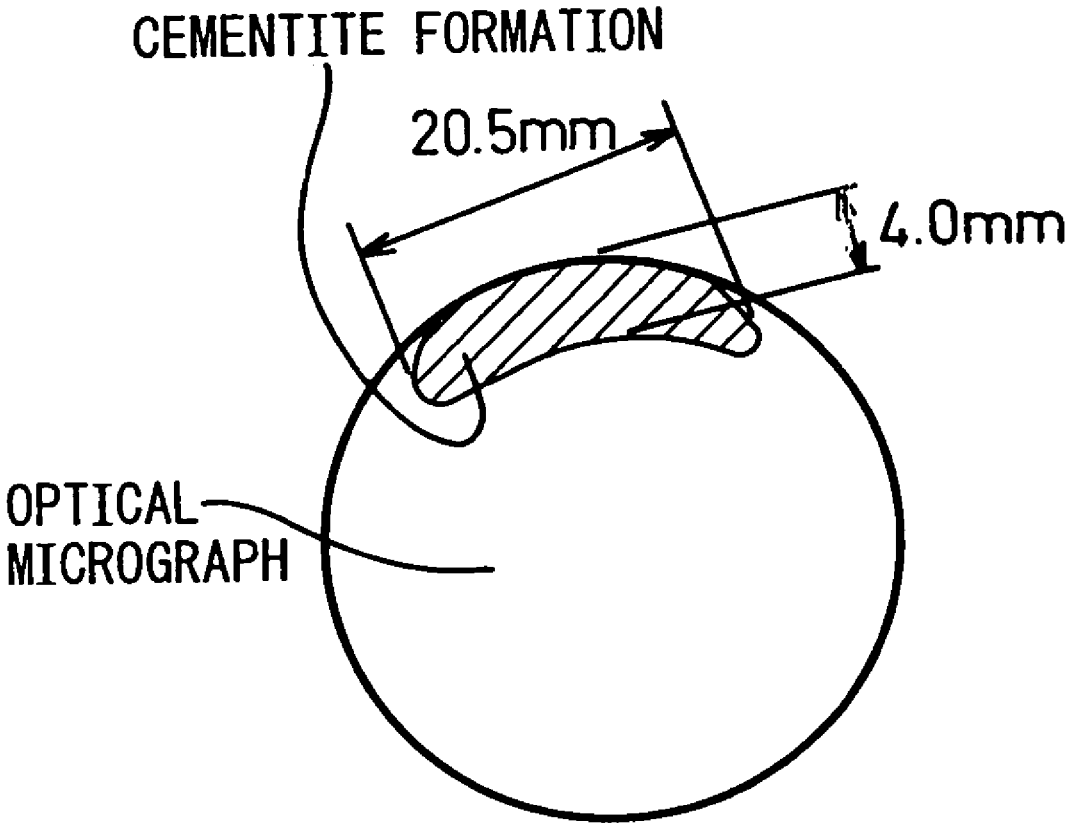
Figure 6B:
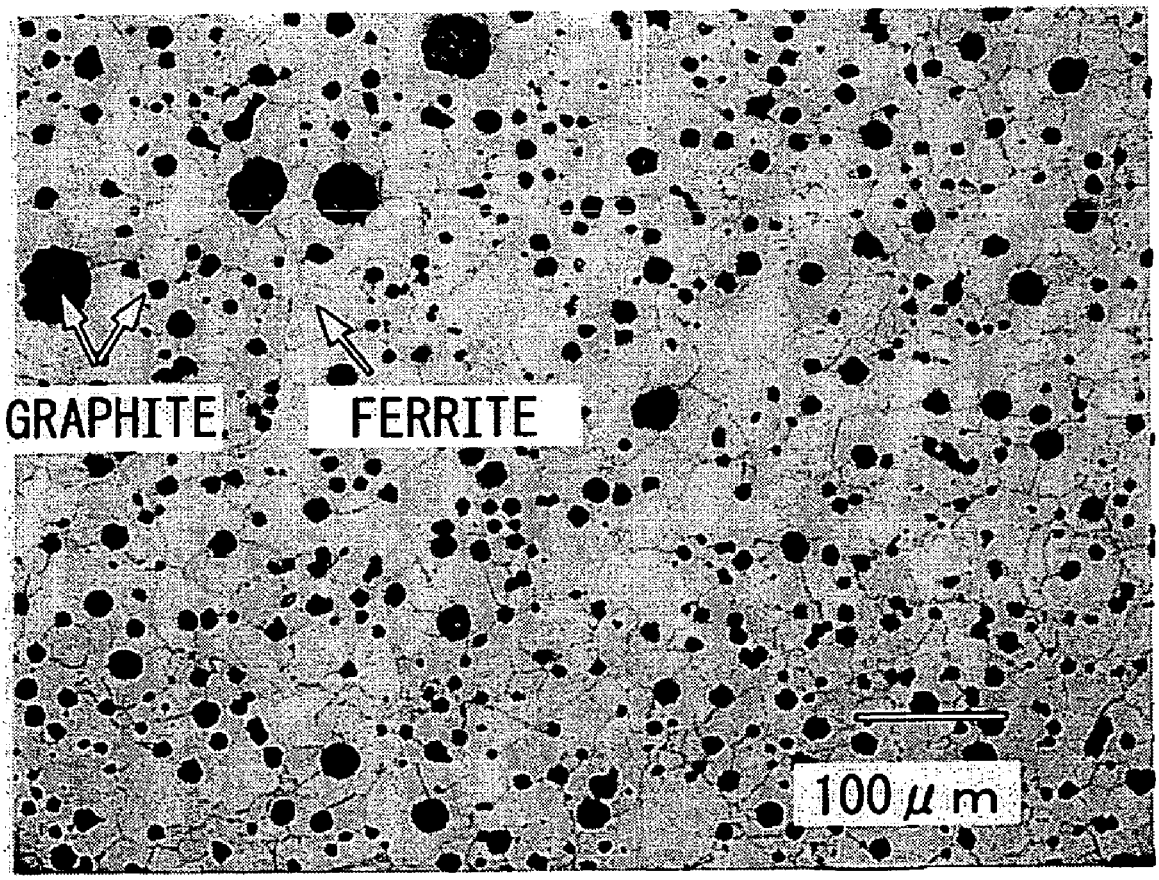
FIG. 6B is an optical micrograph of the metal structure of its center part.

The cylindrical sample obtained by the die/constraint casting according to the present invention is illustrated by a macrosketch of the horizontal cross-section of FIG. 6A and by an optical micrograph of the center part of FIG. 6B. As shown by the macrosketch of FIG. 6A, some formation of cementite was observed at the surface layer of the sample, but the majority of the structure was a microstructure of spheroidal graphite formed finely as shown in FIG. 6B. The spheroidal graphite rate was at least 85%. Note that the spheroidal graphite rate was quantified in accordance with JIS G5502.

The thus prepared sample of the example of the present invention and samples of the comparative examples were cut, then subjected to a fatigue test. The test conditions were as follows:

Fatigue Test Conditions

Test system: Rotating bending fatigue test

Test piece

Heat treatment state: 930° C.×3.5 h+730° C.×6 h

Shape and dimensions: Total length 170 mm, two end clamping parts each ϕ15 mm×60 mm, center test part ϕ12 mm×50 mm (*)

(*) Including transition zone (R25) with two clamping parts

Figure 7:
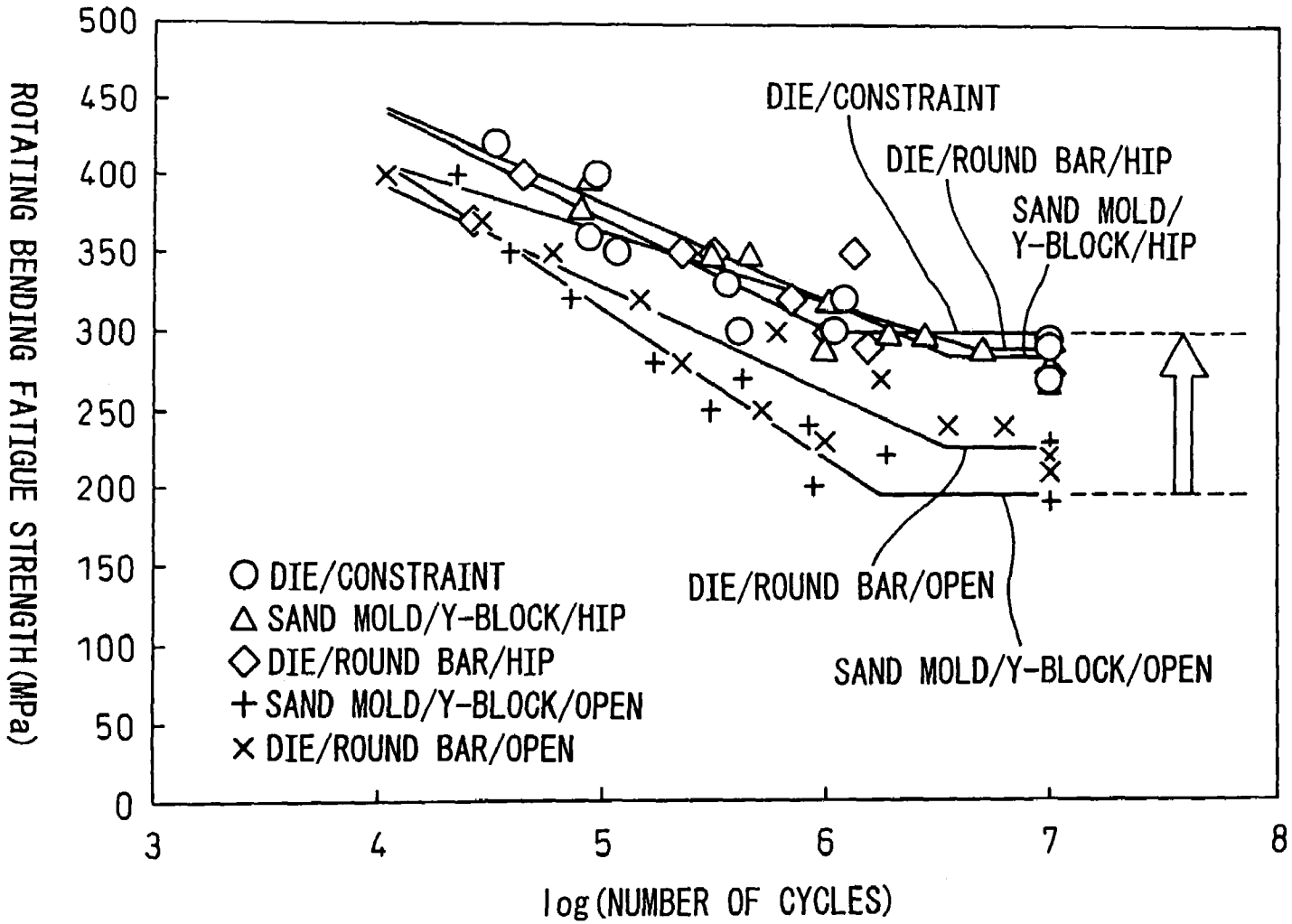
FIG. 7 is a graph of the results of a rotating bending fatigue test for the inventive example and comparative examples.

FIG. 7 shows the results of the fatigue test all together. The shapes of the plots in the figure correspond to the sample Nos. shown in Table 1.

○: Example of present invention (Sample No. 1, die/constraint casting)

Δ: Comparative example (Sample No. 4, sand mold/open casting+HIP treatment (*1))

◇: Comparative example (Sample No. 5, die/open casting+HIP treatment (*1))

+: Comparative example (Sample No. 2, sand mold/open casting)

×: Comparative example (Sample No. 3, die/open casting)

(*) HIP treatment conditions

Pressure: 98 MPa, Ar atmosphere

Temperature: 930° C.

Time: 3.5 h

As shown in FIG. 7, the inventive examples obtained by die/constraint casting (○) was vastly improved in fatigue strength and fatigue limit compared with the comparative examples obtained by open casting by a sand mold or die (+, ×) and gave the same high level as the comparative examples obtained by open casting by a sand mold or die with HIP treatment (Δ, ◇). When compared by $10^7$-cycle fatigue strength, the comparative examples obtained by open casting (no HIP treatment) (+, ×) exhibited a level of 200 MPa. In contrast, the inventive example exhibited a level of 300 MPa, which is an equal high level as the comparative example obtained by open casting with HIP treatment (Δ, ◇). Note that for all samples, the repeat load $10^7$ was in the area where the horizontal part (constant part) of the fatigue curve appeared, so here the $10^7$ fatigue strength can be considered the substantial fatigue limit.

Figure 8:
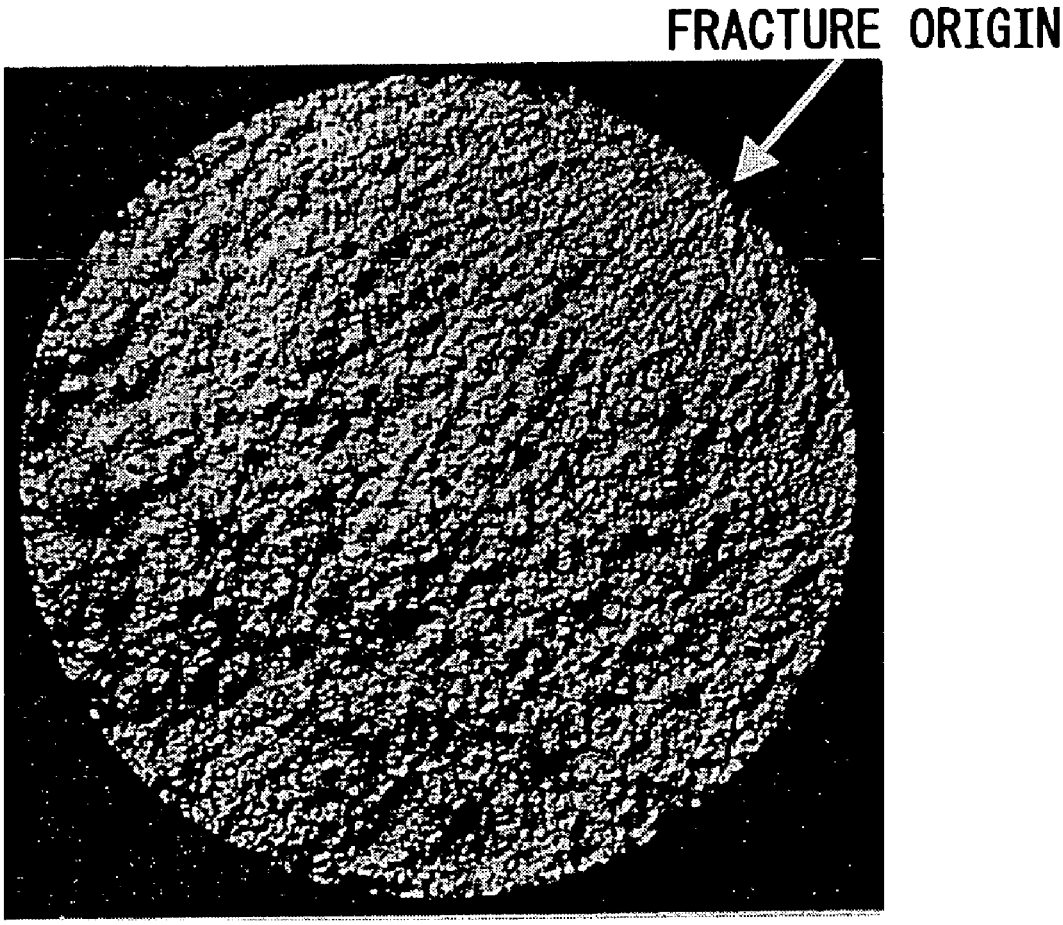
FIG. 8 is a macrophotograph of the microstructure of the overall fracture surface of a sample after the fatigue test.

The fracture surface of a sample was observed after the above fatigue test. FIG. 8 shows a macrophotograph of the fracture surface, while FIGS. 9A and 9B show scanning electron micrographs of the fracture origin of the fracture surface.

As illustrated in FIG. 8, a fatigue crack occurred starting from the surface of the sample in each case, propagated to the entire sectional surface, and reached final fracture. It was learned that the fatigue crack proceeded in a radial shape (fan shape) from the point (origin) shown by the arrow in the figure. When the fatigue crack grew and exceeded the critical crack size (determined by the fracture toughness value inherent to material), an unstable fracture occurred and reached full sectional breakage all at once.

Figure 9A:
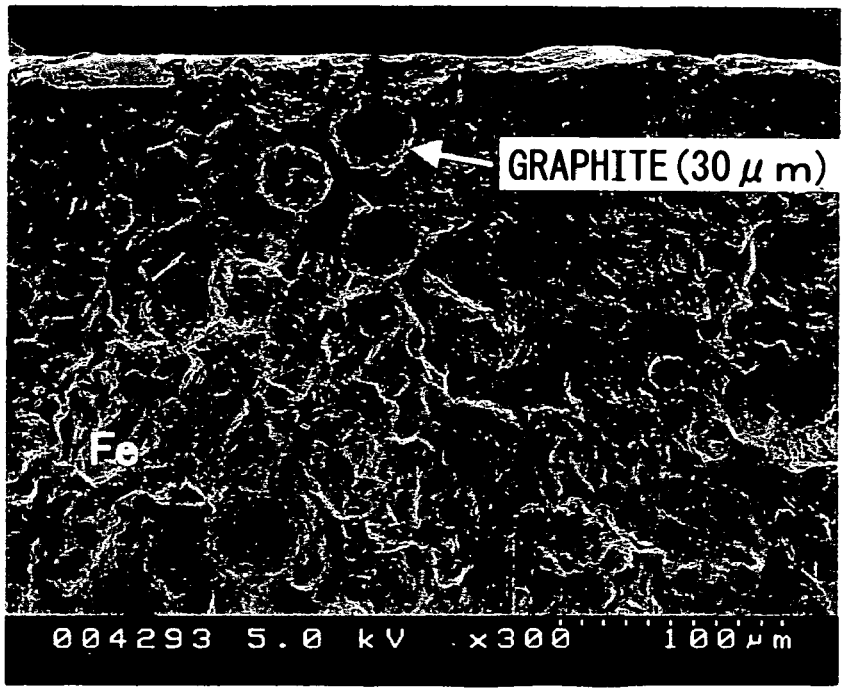
Figure 9B:
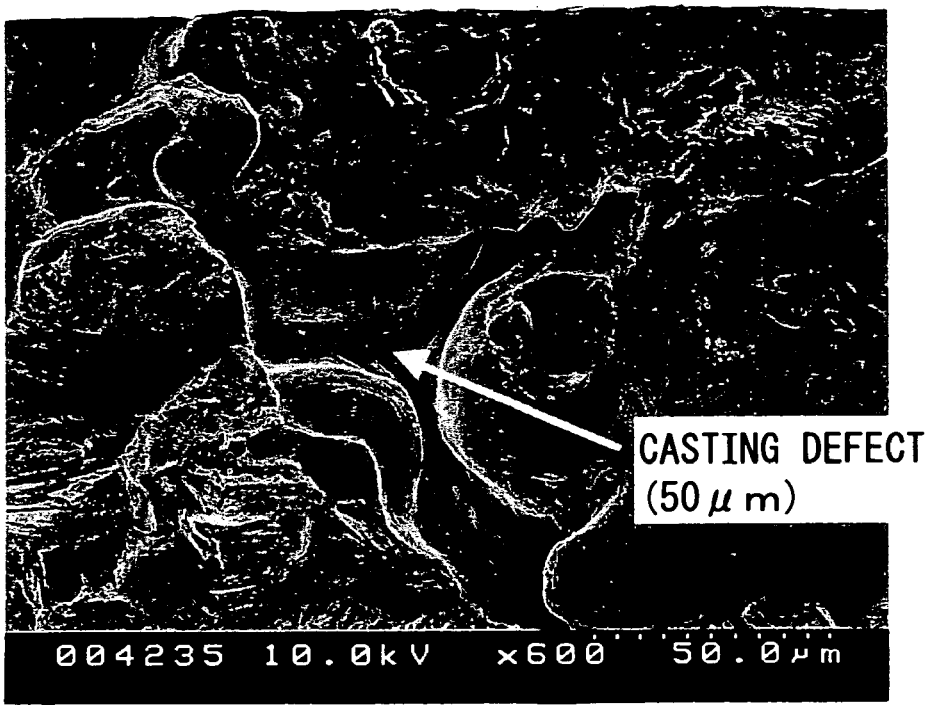

In the case of the die/constraint casting by the present invention, as shown in FIG. 9A, spheroidal graphite particles of 30 μm or so size are present at the macroscopic fracture origin. It is believed that fatigue cracks occur at these particles (sources of concentration of stress due to phase interface). As opposed to this, in the case of open casting by a sand mold or die (both with no HIP treatment), as shown in FIG. 9B, casting defects of 50 μm or so size are present at the macroscopic fracture origin. It is believed that fatigue cracks occur at these defects (sources of concentration of stress due to air gaps).

Note that even when applying HIP treatment to an open-cast product obtained by a sand mold or die, the presence of spheroidal graphite particles of a size of about 30 μm at the fracture origin is observed, such as found in the inventive example shown in FIG. 9A. These are believed to become the sources of fracture.

In this way, due to the die/constraint casting according to the present invention, no large casting defect of 50 μm or more which would induce fatigue cracks is formed. Due to this, at least the formation of a fatigue crack is suppressed and the fatigue strength (fatigue limit) is greatly improved. Further, if considering the fracture mechanism of the fatigue crack proceeding through three stages of crack formation, crack growth, and unstable fracture, the absence of large casting defects also means an improvement of the resistance to crack growth and final unstable fracture and improves the fatigue characteristics as a whole.

The present invention casting (Sample No. 1) exhibits an equivalent fatigue characteristic (fatigue curve) as the comparative examples (Sample Nos. 4 and 5) of open castings by a sand mold or die with HIP treatment, so it may be considered that an effect of reduction of casting defects substantially equal to the effect of reduction of casting defects by HIP treatment was obtained by the die/constraint casting of the present invention.

Preferable Modes of Heat Insulation Layer Material

To stably obtain the effects of crystallization of spheroidal graphite and reduction of casting defects due to the die/constraint casting of the present invention, a heat insulation layer provided at the inside walls of the die cavity is extremely important.

In general, in die casting of cast iron, diatomaceous earth or another clay mineral is used as a mold coating. This clay mineral-based mold coating is used to suppress the heat shock or wear due to direct contact with the high temperature molten metal so as to improve the durability of the die. However, with such a conventional mold coating, the heat insulation property is low and even if coated to the usual thickness of 1 to 2 mm, it is not possible to stably prevent the formation of chill crystals (cementite).

As opposed to this, the hollow mullite used in this example is provided with an extremely high insulating property and is desirable as a material used for the heat insulation layer of the present invention. In practice, solid silica is blended into hollow mullite to form a coating and prevent precipitation and a binder (bentonite, water glass, etc.) is added to this for use.

A casting experiment was performed using heat insulation layers (Nos. 11 to 14) changed in ratio of hollow mullite powder and silica powder as shown in Table 2. For comparison, a similar casting experiment was performed for the case of no heat insulation layer (Comparison A) and the case of conventional coating of a mold coating (Comparison B).

TABLE 2

Results of Boat Die Experiment

| No. | Hollow mullite:silica (weight ratio) | Heat conductivity (W/mK) | Cooling rate (rank) | Chill |
|---|---|---|---|---|
| Comp. A | (Die) | — | 1 (fastest) | Yes |
| Comp. B | (Silica coated die) | — | 2 | Yes |
| 11 | 0:100 | 0.39 | 3 | Yes |
| 12 | 25:75 | 0.25 | 4 | No |
| 13 | 50:50 | 0.21 | 5 | No |
| 14 | 100:0 | 0.19 | 6 (slowest) | No |

Figure 10:
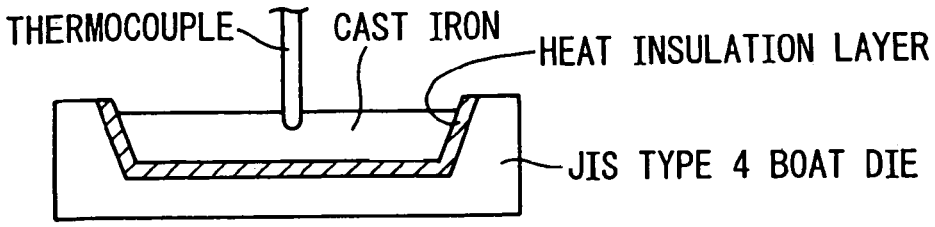
FIG. 10 is a sectional view of a boat die for a casting experiment for various heat insulation coatings.
Figure 11:
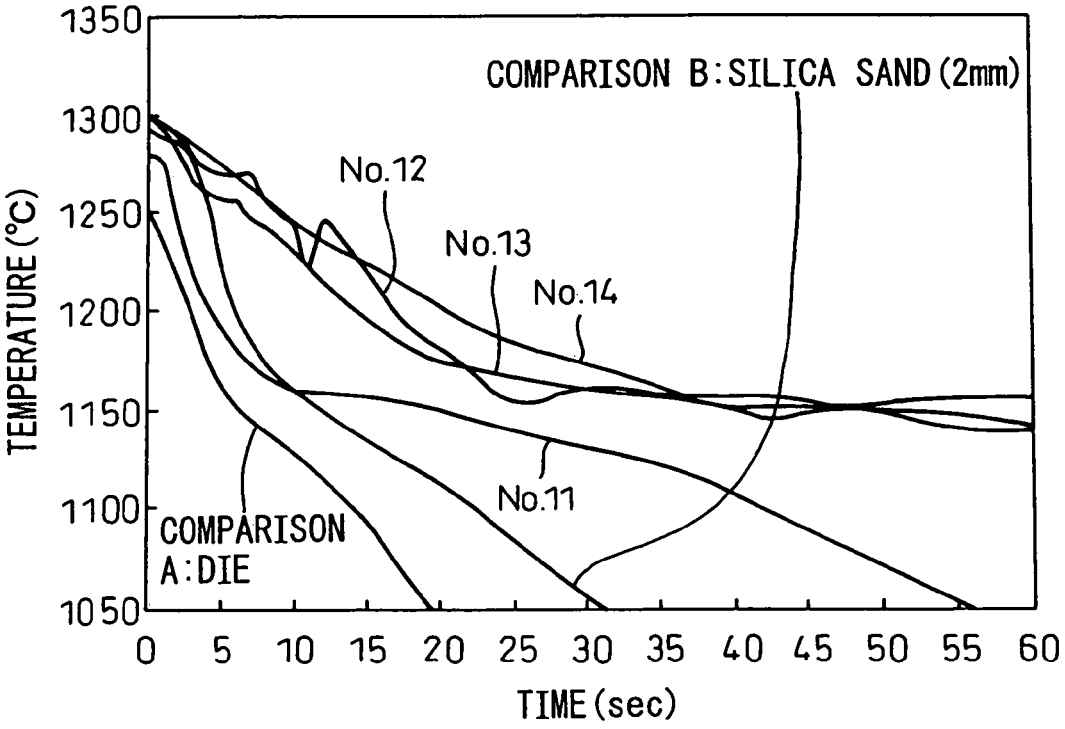
FIG. 11 is a graph of a temperature change curve measured in a casting experiment using various heat insulation coatings.

As shown in FIG. 10, we formed a heat insulation layer at the inside walls of the cavity of a JIS Type 4 boat die, poured cast iron molten metal of the above composition, and continuously measured the temperature of the molten metal in the casting die by a thermocouple. The thickness of the mullite/silica heat insulation layer was made the maximum film-forming thickness, that is, 600 μm. If thicker than this, the heat insulation layer will peel off and cannot be maintained stably. Further, the thickness of a conventional mold coating was made the generally used 2 mm. FIG. 11 shows the results of measurement of the temperature. Further, the results of measurement of the heat conductivity of the heat insulation layer and the results of observation of the casting structure (presence of chill crystals) are shown in Table 2.

As shown in FIG. 11 and Table 2, the cooling rate could be made slower than a conventional mold coating and chill crystals prevented from being formed in the Nos. 12, 13, and 14 heat insulation layers. From these results, it was learned that the heat conductivity of the heat insulation layer was not more than 0.25 W/mK. Further, the thickness of the heat insulation layer is preferably made not more than 600 μm from the viewpoint of the film-formability.

Summarizing the effects of the invention, according to the present invention, there is provided a method of die casting of a spheroidal graphite cast iron which can prevent formation of chill crystals (cementite) to cause crystallization of fine spheroidal graphite and simultaneously prevent internal defects.

While the invention has been described with reference to specific embodiments chosen for purpose of illustration, it should be apparent that numerous modifications could be made thereto by those skilled in the art without departing from the basic concept and scope of the invention.

What is claimed is:

1. A method of die-casting spheroidal graphite cast iron with a non-feeder design, comprised of the steps of:

preparing a die formed with a heat insulation layer at inside walls of a cavity, wherein said heat insulation layer has a heat conductivity of not more than 0.25 W/mK and a thickness of not more than 600 μm, filling molten metal having a composition of the spheroidal graphite cast iron through a runner into said cavity, closing said runner so as to seal said cavity right before the molten metal in said cavity starts to solidify, and allowing said molten metal to solidify by the action of the inside pressure caused by crystallization of the spheroidal graphite in said sealed cavity.

2. A method as set forth in claim 1, wherein said heat insulation layer is substantially comprised of hollow ceramic particles, solid ceramic particles, and a binder.

* * * * *